US008095054B2

(12) United States Patent
Nakamura

(10) Patent No.: US 8,095,054 B2
(45) Date of Patent: Jan. 10, 2012

(54) TRANSFER DEVICE AND IMAGE FORMING APPARATUS USING THE SAME

(75) Inventor: Ginga Nakamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 91 days.

(21) Appl. No.: 12/774,758

(22) Filed: May 6, 2010

(65) Prior Publication Data

US 2010/0316419 A1 Dec. 16, 2010

(30) Foreign Application Priority Data

Jun. 10, 2009 (JP) ..... 2009-138796

(51) Int. Cl.
*G03G 15/01* (2006.01)

(52) U.S. Cl. ..... 399/302; 399/162; 399/165; 399/308

(58) Field of Classification Search ..... 399/159, 399/162–165, 297, 302, 303, 308; 198/840
See application file for complete search history.

(56) References Cited

U.S. PATENT DOCUMENTS 6,453,143 B2 * 9/2002 Takeuchi ..... 399/303
7,623,816 B2 * 11/2009 Maki et al. ..... 399/312

FOREIGN PATENT DOCUMENTS

JP 04-242280 8/1992
JP 2003-005583 1/2003
JP 2004-184697 A 7/2004
JP 2007-041530 A 2/2007

* cited by examiner

*Primary Examiner* — Hoan Tran
(74) *Attorney, Agent, or Firm* — Renner, Otto, Boisselle & Sklar, LLP

(57) ABSTRACT

The transfer portion for use in an image forming apparatus includes: an intermediate transfer belt having a toner image temporarily transferred from a photoreceptor drum; roller members that support and stretch the intermediate transfer belt; and strip-like guide elements that guide conveyance of the intermediate transfer belt. The guide elements are provided on the inner peripheral surface of the intermediate transfer belt with the first and second ends opposed to and arranged a predetermined gap apart from each other. Each of the first and second ends is formed with a first (second) perpendicular surface that is perpendicular to the advancing direction of the belt and a first (second) inclined surface that is inclined relative to the belt advancing direction. The first and second perpendicular surfaces are formed in such a position that the first and second ends become tapered by the first and second inclined surfaces, respectively.

7 Claims, 13 Drawing Sheets

TRANSFER DEVICE AND IMAGE FORMING APPARATUS USING THE SAME

This Nonprovisional application claims priority under 35 U.S.C. §119 (a) on Patent Application No. 2009-138796 filed in Japan on 10 Jun. 2009, the entire contents of which are hereby incorporated by reference.

BACKGROUND OF THE INVENTION (1) Field of the Invention

The present invention relates to a transfer device and an image forming apparatus using the same, and in particular relates to a transfer device which is used in an image forming apparatus such as an electrostatic copier, laser printer, facsimile machine or the like that forms images with toner based on electrophotography and which transfers the toner image formed on the peripheral side of an image bearer by means of an endless belt as well as to an image forming apparatus using the same device.

(2) Description of the Prior Art

Conventionally, image forming apparatuses based on electrophotography such as copiers, printers, facsimile machines and the like have been known. In these image forming apparatuses based on electrophotographic technique, image forming is performed by forming an electrostatic latent image on the photoreceptor drum (toner image bearer) surface, supplying toner to the photoreceptor drum from a developing device to develop the electrostatic latent image, transferring the toner image that has been formed on the photoreceptor drum by development to a sheet such as paper or the like, and fixing the toner image onto the sheet by means of a fixing device.

In image forming of the image forming apparatus, there are two kinds of transfer methods: one method is that the toner image is directly transferred from the photoreceptor drum to the recording medium and the other method is known as a so-called intermediate transfer method in which the toner image is transferred from the photoreceptor drum to the intermediate transfer medium and then the toner image is transferred to the recording medium. In the image forming apparatus using the intermediate transfer mechanism, an endless intermediate transfer belt is often used as the intermediate transfer medium.

In the image forming apparatus using the intermediate transfer belt, the toner image formed on the peripheral side of the photoreceptor drum is temporarily transferred to the intermediate transfer belt. Particularly, in an image forming apparatus that supports both monochrome and color printing, a plurality of photoreceptor drums for individual colors are arranged along the intermediate transfer belt so that the toner images of different colors are sequentially transferred to the intermediate transfer belt, one over the other. Then the toner image thus formed on the intermediate transfer belt is transferred to the paper.

The intermediate transfer belt used for the above image forming apparatus is generally formed by injection molding and then spreading the molding so as to have a predetermined thinness and length by blow molding or die-molding.

However, the thus formed intermediate transfer belt will present variation in expansion coefficient from one point to another because of uneven distribution of the resin material and the conductive components mixed in the resin material. As a result, the circumference of the belt slightly varies across the belt width.

Accordingly, the intermediate transfer belt suffers the problem of the belt skewing during circulatively traveling due to the difference in circumference depending on the points across the belt width and due to variation in dimensional accuracy and attachment accuracy of the roller members (drive roller, driven roller, etc.) that support and stretch the intermediate transfer belt.

To deal with this, in order to prevent the intermediate transfer belt from skewing, there is a known technology of preventing intermediate transfer belt 61 from skewing by providing a pair of projections (which will be referred to hereinbelow as "beads") 6610 along both the edges, with respect to the width direction of the belt, on the interior peripheral surface of intermediate transfer belt 61 as guide elements for guiding the conveyance of intermediate transfer belt 61 as shown in FIGS. 1A and 1B. These beads are brought in sliding contact with both the end faces of each roller member that supports and stretches intermediate transfer belt 61 to guide intermediate transfer belt 61 being conveyed, whereby skewing of the belt can be prevented.

When bead 6610 is provided for endless intermediate transfer belt 61, each strip-like bead 6610 is formed annularly so that both ends, designated at 6611 and 6612 of bead 6610 are arranged so as to oppose each other with a predetermined distance apart therebetween. This gap serves as a positioning mark. The positioning portion of conventional bead 6610 is usually defined by simple surface (which will be referred to hereinbelow as "perpendicular surface") 6611*a* and 6612*a* that are perpendicular to the advancing direction (moving direction) of the intermediate transfer belt.

However, if the positioning mark of bead 6610 is formed by perpendicular surface 6611*a* and 6612*a* alone, there occurs the problem that the roller members are prone to run up on bead 6610. This occurs because the gap in the positioning mark of bead 6610 and each of the roller members are arranged parallel, so that the roller member easily enters the gap in the positioning mark.

There is also another problem that if the positioning mark of bead 6610 collides with the endface of the roller member, the edges of the positioning mark are prone to deform and peel off.

In order to solve the above problem, there has been a disclosed technology shown in FIGS. 2A and 2B in which the positioning mark defined by both ends 7611*a* and 7612*a* (7611*b* and 7612*b*) of each of bead 7610*a* (7610*b*) for guiding conveyance of intermediate transfer belt 61 is formed by an inclined surface 7611*a*1 and 7612*a*1 (7611*b*1 and 7612*b*1) that are inclined relative to the advancing direction of intermediate transfer belt 61 (see patent document 1: Japanese Patent Application Laid-open H04-242280).

This configuration of patent document 1, however, has the problem that when the positioning mark at each of beads 7610*a* and 7610*b* is formed of only inclined surface 7611*a*1 and 7612*a* (7611*b*1 and 7612*b*1) that are inclined relative to the advancing direction of intermediate transfer belt 61, it is impossible to keep the bonding strength high enough at the tip of the inclination, hence beads 7610*a* and 7610*b* are highly likely to peel off from intermediate transfer belt 61.

SUMMARY OF THE INVENTION

The present invention has been devised in view of the above problems, it is therefore an object of the present invention to provide a transfer device that uses an intermediate transfer belt and that can inhibit damage to, and peeling of, the guide elements for guiding conveyance of the intermediate transfer belt so as to prevent the intermediate transfer belt from skewing, and hence can realize high-quality image forming as well as providing an image forming apparatus using the transfer device.

In order to achieve the above object, the transfer device according to the present invention and the image forming apparatus using this device are configured as follows:

The first aspect of the present invention resides in a transfer device for use in an image forming apparatus that forms images with toner based on electrophotography, comprising: an endless belt having a toner image temporarily transferred from a photoreceptor drum; roller members that support and stretch the endless belt; and, strip-like guide elements that guide conveyance of the endless belt along both ends of the roller members with respect to the width direction, and is characterized in that the guide element includes first and second ends; the guide element is formed on the inner peripheral surface of the endless belt that opposes the roller members; the first and second ends are arranged so as to oppose each other with a predetermined gap apart therebetween, on the inner peripheral surface; the first end is formed with a first perpendicular surface that is perpendicular to the advancing direction of the endless belt and a first inclined surface that is inclined relative to the advancing direction; and the second end is formed with a second perpendicular surface that is perpendicular to the advancing direction and a second inclined surface that is inclined relative to the advancing direction.

The second aspect of the present invention resides in that the first and second perpendicular surface are formed at least one side of both sides of the first and second inclined surface, respectively.

The third aspect of the present invention resides in that the first and second perpendicular surface are formed in positions where the first and second ends become tapered by the first and second inclined surface, respectively.

That is, the first and second perpendicular surface are formed so that the tips of the first and second ends will not be pointed.

The fourth aspect of the present invention resides in that the second perpendicular surface is formed between the second inclined surface and a guide surface that opposes the ends of the roller members.

The fifth aspect of the present invention resides in that the second end includes a third inclined surface that is inclined relative to the advancing direction or a curved surface (e.g., an R-shaped surface) between the second perpendicular surface and the guide surface.

The sixth aspect of the present invention resides in that, when the first and second ends are arranged so as to oppose each other with the predetermined gap apart therebetween, the first end and the opposing second end are formed in a point-symmetrical configuration.

The seventh aspect of the present invention resides in an image forming apparatus for forming images using toner based on electrophotography, comprising: a photoreceptor drum for forming an electrostatic latent image on the surface thereof; a charging device for electrifying the surface of the photoreceptor drum; an exposure device for forming the electrostatic latent image on the surface of the photoreceptor drum; a developing device for forming a toner image by supplying toner to the electrostatic latent image on the surface of the photoreceptor drum; a transfer device for transferring the toner image on the surface of the photoreceptor drum to a recording medium; and, a fixing device for fixing the transferred toner image to the recording medium, characterized in that the transfer device uses the transfer device described in any of the above first to sixths aspects.

According to the first aspect of the present invention, it is possible to secure the strength of the guide elements (for example, the bonding strength when the guide element is attached by bonding) and also prevent the guide elements from running up on the roller members. As a result, it is possible to prevent the guide elements from being damaged or peeling off, and realize high-quality image forming by preventing the endless belt from skewing.

According to the second aspect of the present invention, it is possible to secure the strength of the guide element around the ends of the first and second inclined surfaces, it is hence possible to inhibit the guide element from peeling off.

According to the third aspect of the present invention, the first and second perpendicular surfaces are formed so that the first and second ends will not have a pointed tip, it is hence possible to secure the necessary strength even if the first and second ends have a tapered configuration.

According to the fourth aspect of the present invention, it is possible to inhibit the guide element from running up on the roller members while securing the strength of the guide element.

According to the fifth aspect of the present invention, it is possible to reduce damage to the tip of the second end from the roller members, and inhibit the guide element from running up on the roller members.

According to the sixth aspect of the present invention, since it is not necessary to consider the orientation of the guide element when the guide element is attached to the endless belt, it is possible to improve work efficiency.

According to the seventh aspect of the present invention, it is possible to provide a high quality image forming apparatus by preventing the endless belt of the transfer device from skewing.

DESCRIPTION OF THE PREFERRED EMBODIMENTS

The First Embodiment

The first embodiment of the present invention will hereinafter be described in detail with reference to the accompanying drawings.

Figure 1A:
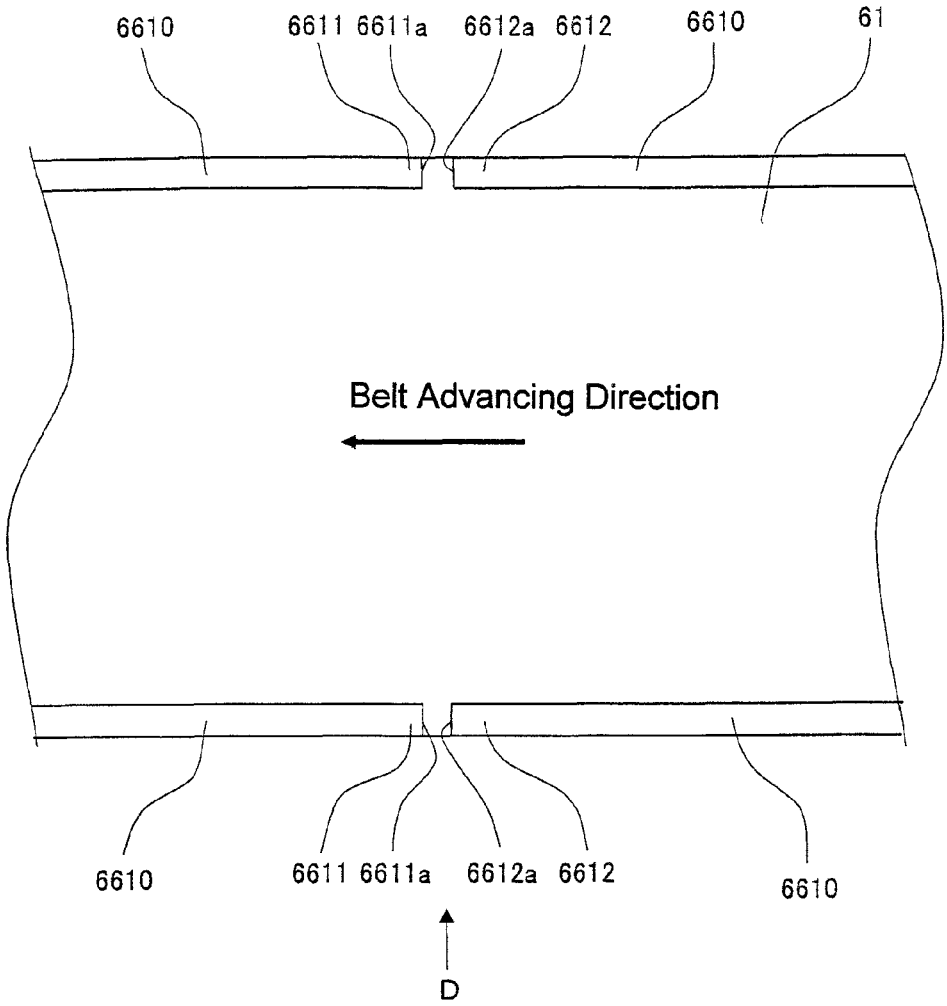
FIG.1A PRIOR ART
FIG. 1A is a front view showing the arrangement of a conventional intermediate transfer belt with guide elements when viewed from the interior side of the belt.
Figure 1B:
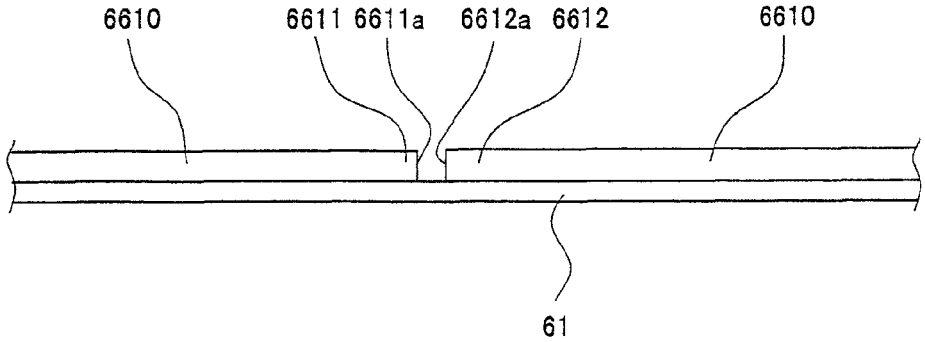
FIG.1B PRIOR ART
FIG. 1B is a side view of the belt when viewed in the direction of arrow D in FIG. 1A.
Figure 2A:
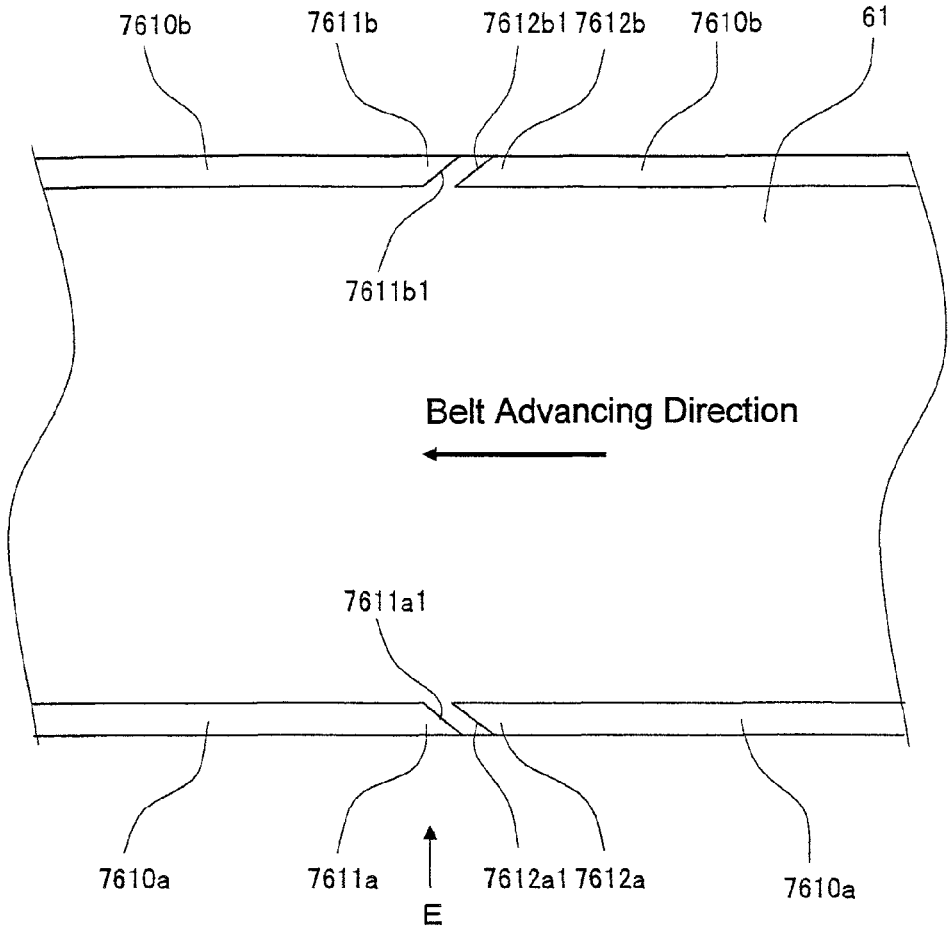
FIG.2A PRIOR ART
FIG. 2A is a front view showing the arrangement of another conventional intermediate transfer belt with guide elements when viewed from the interior side of the belt.
Figure 2B:
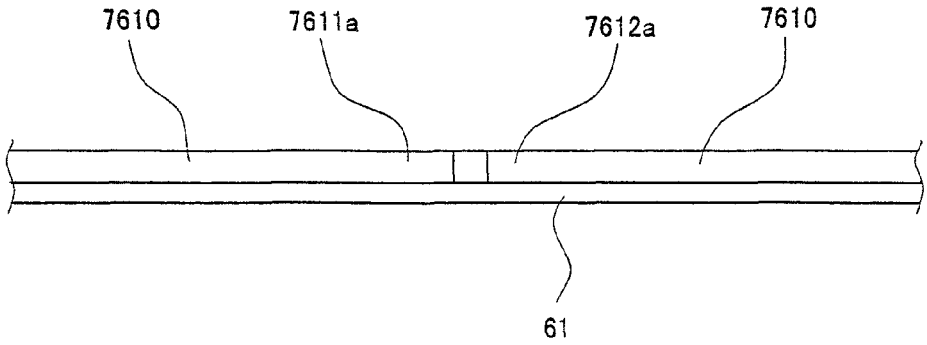
FIG.2B PRIOR ART
FIG. 2B is a side view of the belt when viewed in the direction of arrow E in FIG. 2A.
Figure 3:
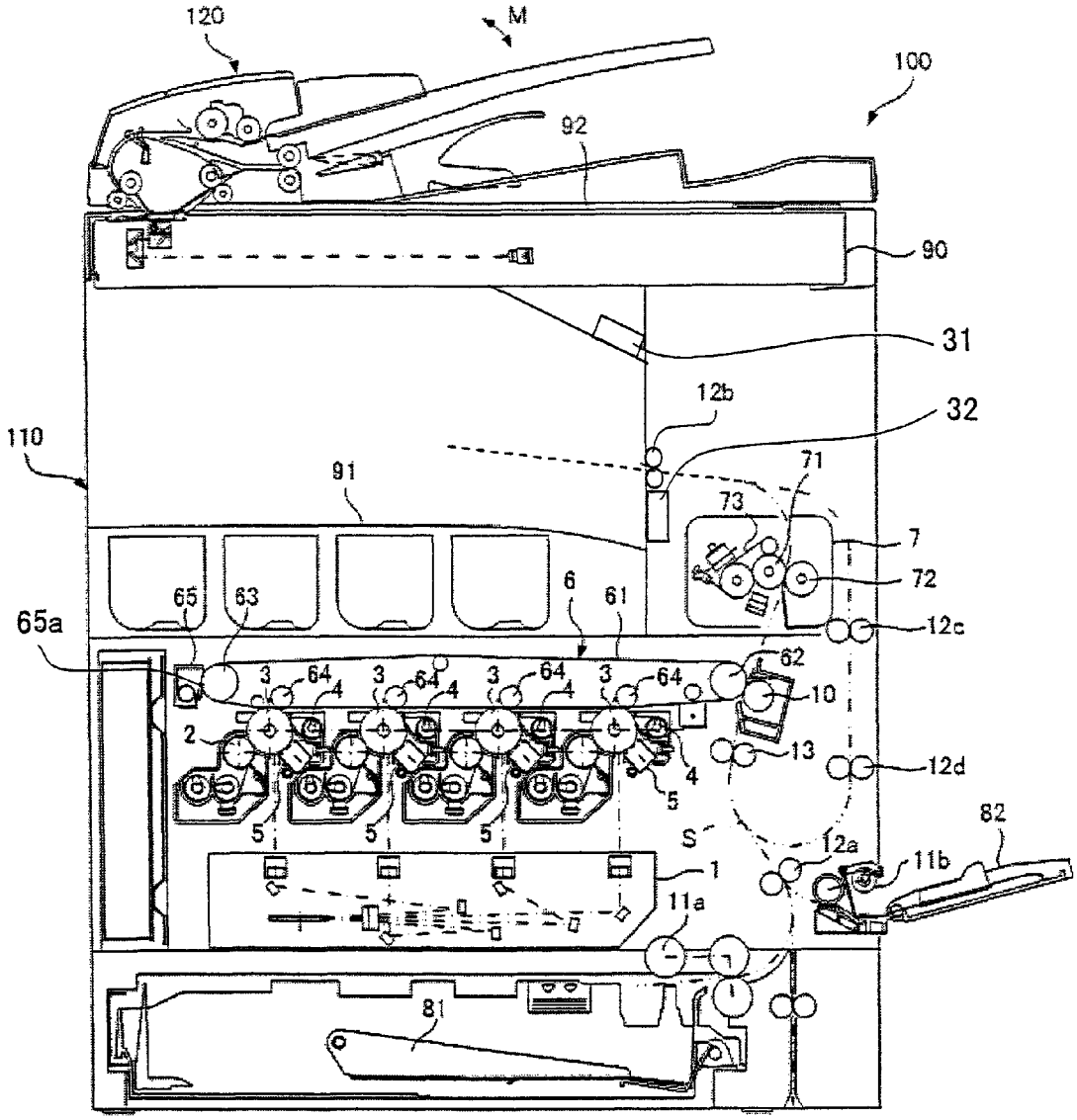
FIG. 3 is an illustrative view showing an overall configuration of an image forming apparatus in which a transfer device according to the first embodiment of the present invention is used.

FIG. 3 shows one exemplary embodiment of the invention, or is an illustrative view showing an overall configuration of an image forming apparatus using a transfer device according to the first embodiment of the present invention.

An image forming apparatus 100 according to the first embodiment for forming images using toner based on electrophotography, including: as shown in FIG. 3, photoreceptor drums 3 on which electrostatic latent images are formed; chargers (charging devices) 5 for electrifying the photoreceptor drum 3 surfaces; an exposure unit (exposure system) 1 for forming electrostatic latent images on the photoreceptor drum 3 surfaces; developing devices 2 for forming toner images by supplying the photoreceptor drum 3 surfaces with toners; transfer portion (transfer device) 6 for transferring the toner images from the photoreceptor drum 3 surfaces to recording paper (recording medium); and a fixing unit (fixing device) 7 for fixing the transferred toner image on the paper.

To begin with, the overall configuration of image forming apparatus 100 will be described.

Image forming apparatus 100 forms a multi-colored or monochrome image on a predetermined sheet (e.g., recording paper) in accordance with image data externally transmitted, and is composed of a main apparatus body 110 and an automatic document processor 120, as shown in FIG. 3.

Main apparatus body 110 includes: exposure unit 1, developing units 2, photoreceptor drums 3, cleaning units 4, chargers 5, transfer portion 6, fixing unit 7, a paper feed cassette 81, a paper output tray 91, and the like.

Arranged in the upper part of main apparatus body 110 is an image reading portion 90. A platen glass (document table) 92 of a transparent glass plate on which a document is placed, is disposed over the image reading portion 90. On the top of platen glass 92, automatic document processor 120 is mounted.

Automatic document processor 120 automatically feeds documents onto platen glass 92.

This document processor 120 is constructed so as to be pivotable in the directions of bidirectional arrow M so that a document can be manually placed by opening the top of platen glass 92.

The image data handled in image forming apparatus 100 is data for color images of four colors, i.e., black (K), cyan (C), magenta (M) and yellow (Y).

Accordingly, four developing units 2, four photoreceptor drums 3, four chargers 5, four cleaning units 4 are provided to produce four electrostatic latent images corresponding to black, cyan, magenta and yellow. That is, four imaging stations are constructed thereby.

Charger 5 is the charging means for uniformly electrifying the photoreceptor drum 3 surface at a predetermined potential. Other than the corona-discharge type chargers shown in FIG. 3, chargers of a contact roller type or brush type may also be used.

Exposure unit 1 corresponds to the image writing device that illuminates the electrified photoreceptor drums 3 in accordance with the data externally input or the image data read out from the document so as to from electrostatic latent images corresponding to the image data on the photoreceptor drum 3 surfaces, and is constructed as an LSU (laser scanning unit) having a laser emitter, reflection mirrors, etc. In this exposure unit 1, a polygon mirror for scanning the laser beam, optical elements such as lenses and mirrors for leading the laser beam reflected off the polygon mirror to photoreceptor drums 3 are laid out.

As exposure unit 1, other methods using an array of light emitting elements such as an EL (electroluminescence) or LED writing head, for example may be used instead.

This thus constructed exposure unit 1 illuminates each of the electrified photoreceptor drums 3 with light in accordance with the input image data to form an electrostatic latent image corresponding to the image data on the surface of each photoreceptor drum 3.

Developing units 2 visualize the electrostatic latent images formed on the photoreceptor drum 3 surfaces with four color (YMCK) toners, respectively.

Photoreceptor drums 3 each have a cylindrical form and are disposed over exposure unit 1. The surface of each photoreceptor drum 3 is cleaned by a cleaner unit 4 so that the cleaned surface is uniformly electrified by charger 5.

Cleaner unit 4 removes and collects the toner left over on the photoreceptor drum 3 surface after development and image transfer stages.

Transfer portion 6 arranged over photoreceptor drums 3 is comprised of an endless intermediate transfer belt (endless belt) 61, an intermediate transfer belt drive roller 62, an intermediate transfer belt driven roller 63, four intermediate transfer rollers 64 corresponding to four YMCK color toners and an intermediate transfer belt cleaning unit 65.

Intermediate transfer belt drive roller 62, intermediate transfer belt driven roller 63 and intermediate transfer rollers 64 support and stretch intermediate transfer belt 61 to circulatively drive the belt.

Intermediate transfer belt 61 is formed of an endless film of about 100 μm to 150 μm thick and is arranged so as to contact with each of photoreceptor drums 3. The toner images of different colors formed on photoreceptor drums 3 are sequentially transferred in layers to intermediate transfer belt 61, forming a color toner image (multi-color toner image) on intermediate transfer belt 61.

Transfer of the toner images from photoreceptor drums 3 to intermediate transfer belt 61 are performed by intermediate transfer rollers 64 that are in contact with the rear side of intermediate transfer belt 61.

Each intermediate transfer roller 64 is applied with a transfer bias so as to transfer the toner image on photoreceptor drum 3 onto intermediate transfer belt 61. Detailedly, a high-voltage transfer bias (high voltage of a polarity (+) opposite to the polarity (−) of the static charge on the toner) is applied to intermediate transfer roller 64 in order to transfer the toner image.

Intermediate transfer roller 64 is a roller that is formed of a base shaft made of metal (e.g., stainless steel) having a diameter of 8 to 10 mm and a conductive elastic material (e.g., EPDM, foamed urethane or the like) coated on the shaft surface. This conductive elastic material enables uniform application of a high voltage to intermediate transfer belt 61. Though the transfer electrodes in the form or rollers are used in the first embodiment, brushes and the like can also be used instead of intermediate transfer rollers 64.

As described above, the visualized toner images of colors on different photoreceptor drums 3 are laid over one after another on intermediate transfer belt 61. The thus laminated toner image as the image information is conveyed as intermediate transfer belt 61 moves, to the contact position between the paper being conveyed and intermediate transfer belt 61 (the secondary transfer position, or predetermined position), and transferred to the paper by means of a transfer roller 10 disposed at this contact position.

During this process, intermediate transfer belt 61 and transfer roller 10 are pressed against each other forming a predetermined nip while a secondary transfer bias for transferring the toner to the paper is applied to transfer roller 10. This secondary bias is a high voltage (of a polarity (+) opposite to the polarity (−) of the static charge on the toner).

Further, in order to constantly obtain the predetermined nip, either transfer roller 10 that presses against intermediate transfer belt 61 at the secondary transfer position or intermediate transfer belt drive roller 62 that presses the rear side of intermediate transfer belt 61 at the secondary transfer position, is formed of a hard material (metal or the like) while the other is formed of a soft material such as an elastic roller or the like (elastic rubber roller, foamed resin roller etc.).

Since the toner adhering to intermediate transfer belt 61 as the belt comes in contact with photoreceptor drums 3 in the above-described transfer stage, or the toner which has not been transferred by transfer roller 10 to the paper and remains on intermediate transfer belt 61, would cause color contamination of toners in the toner image formed at the next operation, the remaining toner is removed and collected by intermediate transfer belt cleaning unit 65.

Intermediate transfer belt cleaning unit 65 is arranged at a position, along the path in which intermediate transfer belt 61 is conveyed, downstream of transfer roller 10 and upstream of photoreceptor drums 3 with respect to the intermediate transfer belt's direction of movement.

Intermediate transfer belt cleaning unit 65 includes a cleaning blade 65*a* as a cleaning member that comes in contact with intermediate transfer belt 61 and cleans the surface of intermediate transfer belt 61. Intermediate transfer belt 61 is supported from its interior side by intermediate transfer belt driven roller 63 at the portion where this cleaning blade 65*a* comes into contact with the belt.

Paper feed cassette 81 is a tray for stacking the paper to be used for image forming and is arranged under exposure unit 1 of main apparatus body 110. Also, a manual paper feed cassette 82 that permits the paper to be externally supplied is arranged outside main apparatus body 110.

This manual paper feed cassette 82 can also hold a plurality of sheets to be used for image forming. Arranged in the upper part of main apparatus body 110 is a paper output tray 91 which collects printed sheets facedown.

Main apparatus body 110 further includes a paper feed path S that extends approximately vertically to convey the paper from paper feed cassette 81 or manual paper feed cassette 82 to paper output tray 91 by way of transfer roller 10 and fixing unit 7. Arranged along paper feed path S from paper feed cassette 81 or manual paper feed cassette 82 to paper output tray 91 are pickup rollers 11*a* and 11*b*, a plurality of feed rollers 12*a* to 12*d*, a registration roller 13, transfer roller 10, fixing unit 7 and the like.

Feed rollers 12*a* to 12*d* are small rollers for promoting and supporting conveyance of the paper and are arranged along paper feed path S. Here, since feed roller 12*b* functions as a paper discharge roller for discharging the paper to paper output tray 91, this roller is called the paper discharge roller.

Pickup roller 11*a* is arranged near the end of paper feed cassette 81 so as to pick up the paper, sheet by sheet, from paper feed cassette 81 and deliver the paper to paper feed path S.

Pickup roller 11*b* is arranged near the end of manual paper feed cassette 82 so as to pick up the paper, sheet by sheet, from manual paper feed cassette 82 and deliver the paper to paper feed path S.

Registration roller 13 temporarily suspends the paper that is conveyed along paper feed path S. This roller has the function of delivering the paper toward transfer roller 10 at such a timing that the front end of the paper will meet the front end of the image data area on intermediate transfer belt 61. That is, this function of registration roller 13 makes the toner image on intermediate transfer belt 61 in register with the paper being conveyed and enables the toner image to be transferred to the predetermined position of the paper.

Fixing unit 7 includes a heat roller 71 and a pressing roller 72. Heat roller 71 and pressing roller 72 are arranged so as to rotate and convey the paper while nipping the paper.

Heat roller 71 and pressing roller 72 are arranged opposing each other and forming a fixing nip portion at the contact point therebetween.

The temperature of heat roller 71 is controlled and set at a predetermined temperature by means of an unillustrated controller. This controller performs temperature control so that the surface temperature of heat roller 71 falls within the range of 160 to 200 deg. C., based on the detected signal from an unillustrated temperature sensor (non-contact type thermistor) that is disposed near the heat roller 71 surface to detect the temperature of heat roller 71.

Further, heat roller 71 heats and presses the toner to the paper in cooperation with pressing roller 72 so as to thermally fix the multi-color toner image transferred onto the paper, to the paper, by fusing, mixing and pressing the toner image. In addition, an external fixing belt 73 is put in contact with the outer periphery of heat roller 71, as shown in FIG. 3.

Similarly to heat roller 71, pressing roller 72 also is composed of a cylindrical metal core and an elastic layer formed on the peripheral surface of the metal core. This pressing roller is arranged to abut heat roller 71 with a predetermined pressure.

Next, the configuration of transfer portion (transfer device) 6 will be described in detail with reference to the drawings.

Figure 4:
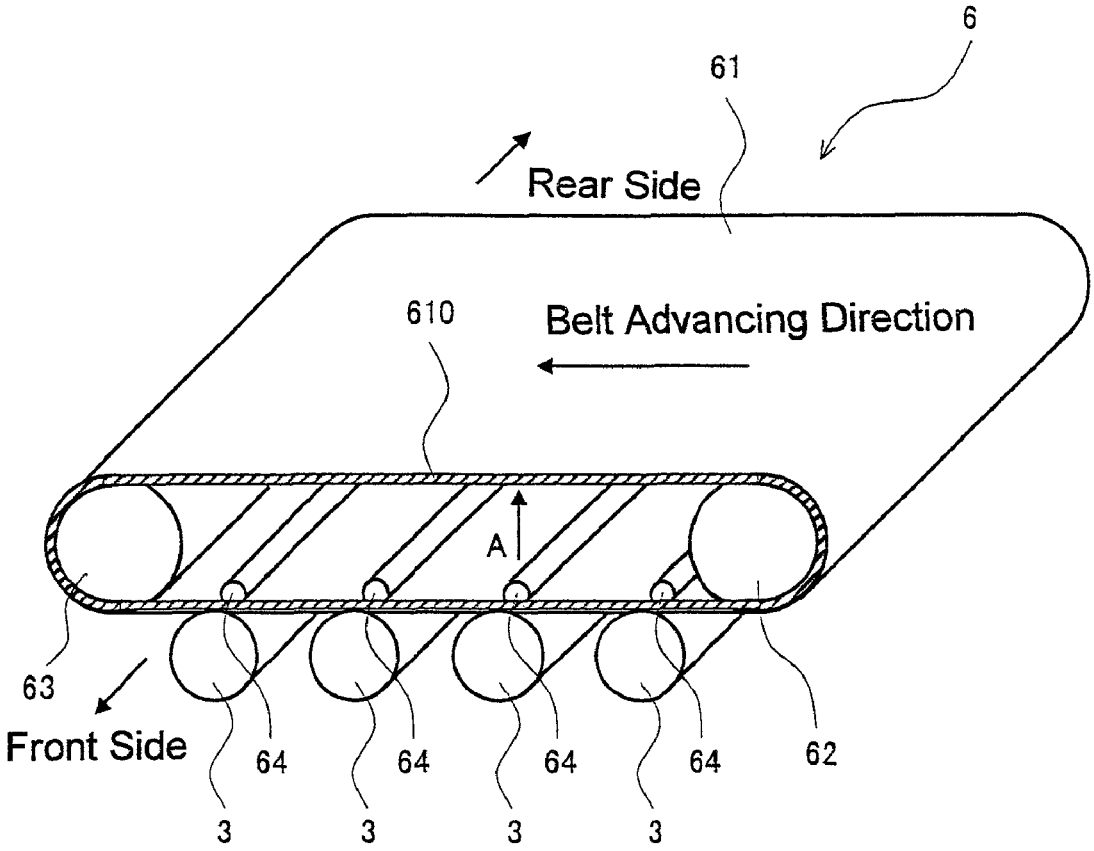
FIG. 4 is a perspective view showing a configuration of a transfer portion of the present embodiment.
Figure 5:
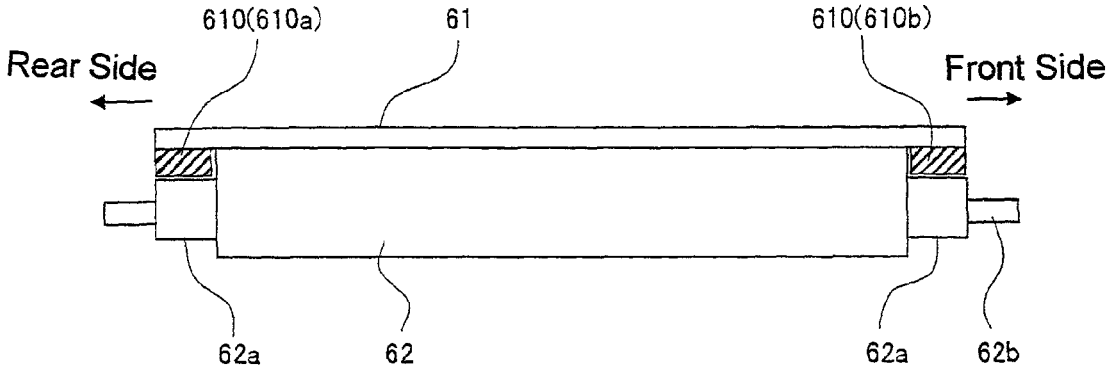
FIG. 5 is an illustrative view showing the positional relationship between an intermediate transfer belt and a roller member that constitute the transfer portion.
Figure 6A:
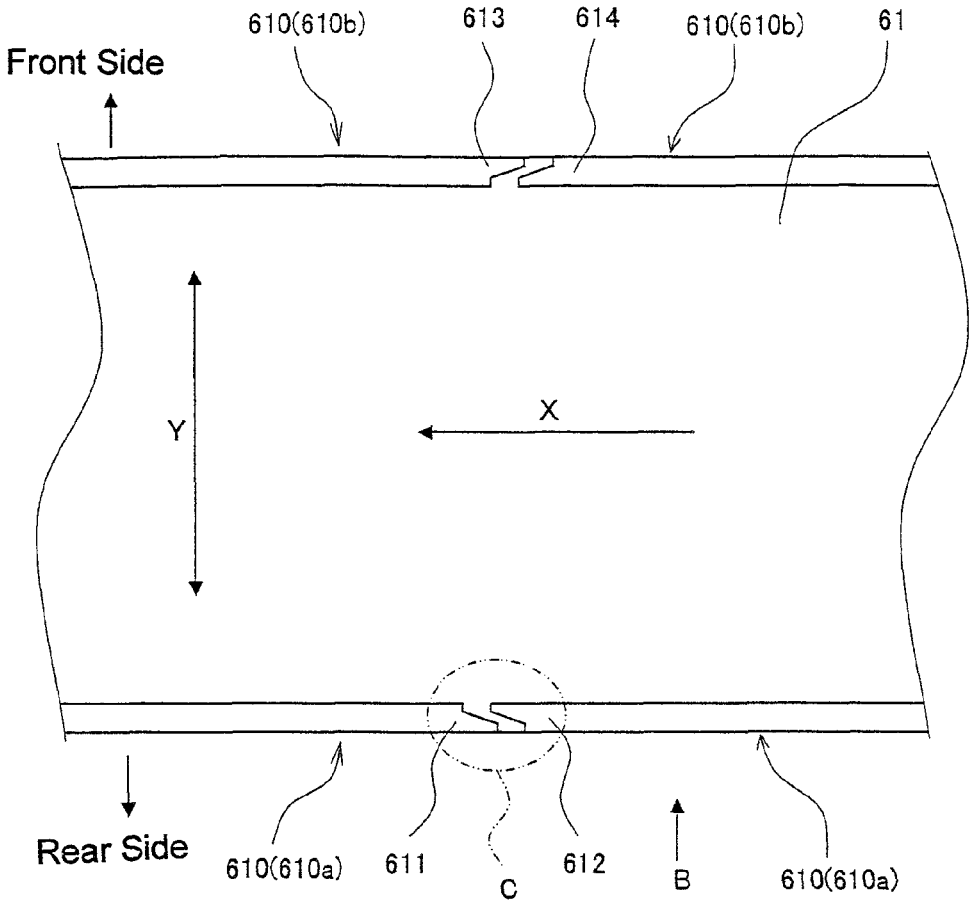
FIG. 6A is a front view showing the intermediate transfer belt with the guide elements when viewed in the direction of arrow A in FIG. 4.
Figure 6B:
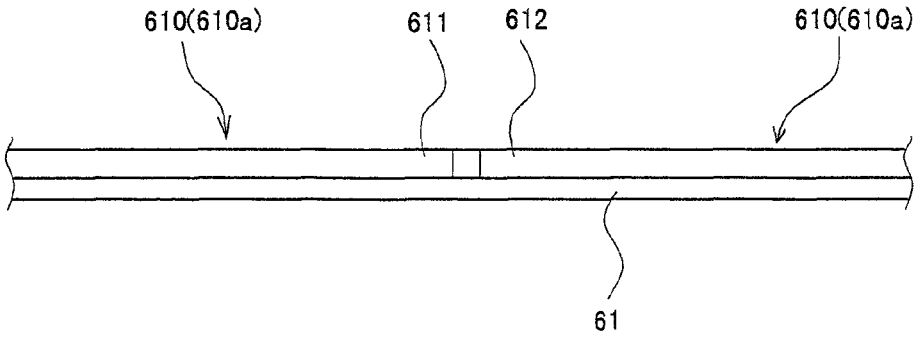
FIG. 6B is a side view of the belt when viewed in the direction of arrow B in FIG. 6A.
Figure 7:
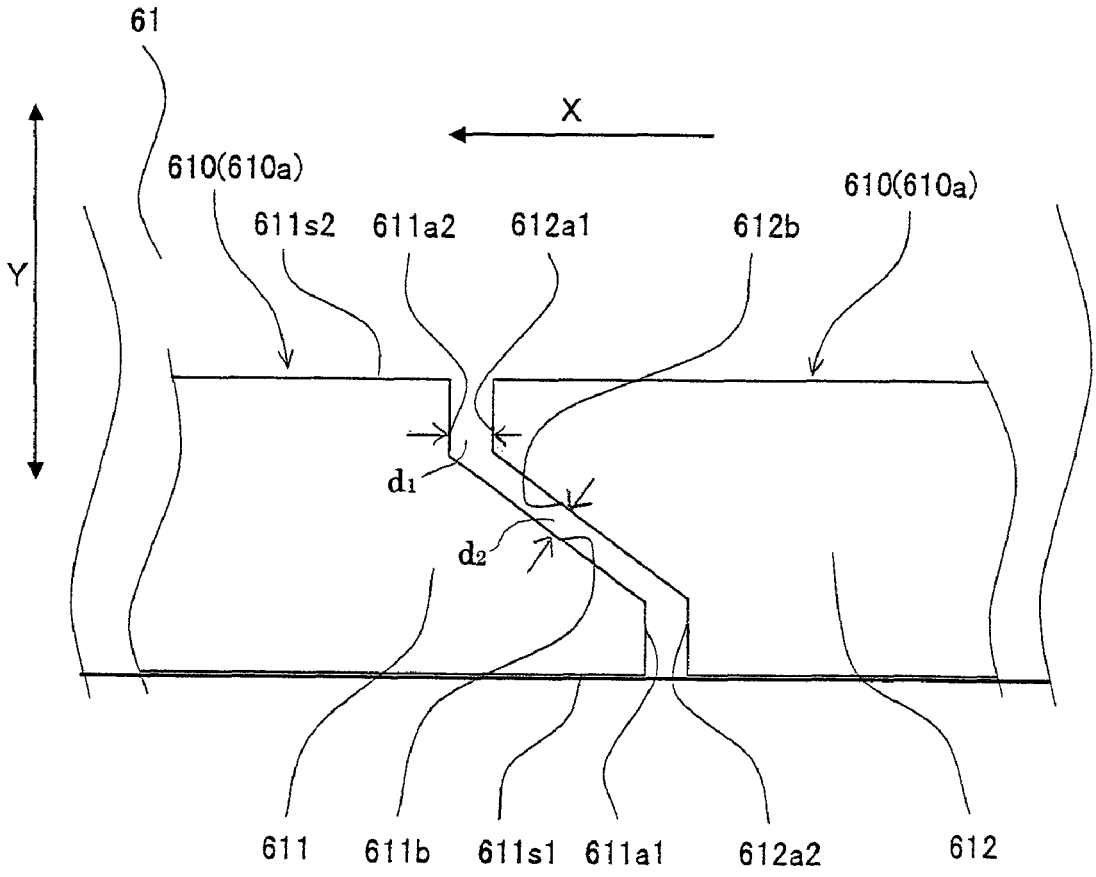
FIG. 7 is an enlarged view showing a portion C encircled by a dash and double-dot line in FIG. 6A.
Figure 8:
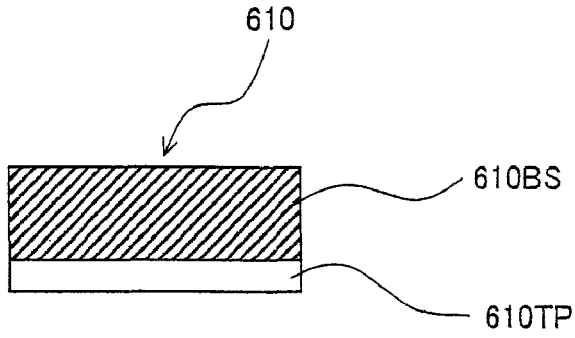
FIG. 8 is a sectional view showing the configuration of the guide element.

FIG. 4 is a perspective view showing a configuration of a transfer portion of the first embodiment. FIG. 5 is an illustrative view showing the positional relationship between an intermediate transfer belt and a roller member that constitute the transfer portion. FIG. 6A is a front view showing the intermediate transfer belt with guide elements when viewed in the direction of arrow A in FIG. 4. FIG. 6B is a side view of the belt when viewed in the direction of arrow B in FIG. 6A. FIG. 7 is an enlarged view showing a portion C encircled by a dash and double-dot line in FIG. 6A. FIG. 8 is a sectional view showing the configuration of the guide element.

As shown in FIG. 4, in transfer portion 6, a plurality of roller members including intermediate transfer belt drive roller 62, intermediate transfer belt driven roller 63 and intermediate transfer rollers 64, stretch and circulatively drive intermediate transfer belt 61.

A pair of strip-like guide elements 610 (610*a* and 610*b*) are bonded at both edges with respect to the belt width, on the inner peripheral side of the belt which the roller members (62, 63 and 64) abut.

As shown in FIG. 5, guide elements 610 are arranged so as to be projected inwards from the inner peripheral side of intermediate transfer belt 61. Guide elements 610 guide intermediate transfer belt 61 so that the axial ends of each roller member (e.g., intermediate transfer belt drive roller 62) will be positioned within the width of intermediate transfer belt 61. In the figure, reference numerals 62*a* and 62*b* designate a collar for assisting conveyance of guide element 610 and a rotational shaft, respectively.

With this configuration, it is possible to inhibit skewing of intermediate transfer belt 61.

Now, the configuration of guide elements 610 will be described in detail with reference to the drawings.

As shown in FIG. 6A, guide elements 610 include first and second guide elements 610*a* and 610*b* that are arranged on the inner peripheral side of intermediate transfer belt 61 at both edges (on the rear side and front side) thereof in the belt width (with respect to the Y-direction).

First and second guide elements 610*a* and 610*b* are each formed of a strip-like piece.

First guide element 610*a* is provided on intermediate transfer belt 61 so that the first and second ends, designated at 611 and 612 are arranged so as to oppose each other with a predetermined distance apart therebetween. Similarly, second guide element 610*b* is provided on intermediate transfer belt 61 so that the first and second ends, designated at 613 and 614 are arranged so as to oppose each other with a predetermined distance apart therebetween. That is, guide elements 610*a* and 610*b* are each formed annularly along the endless intermediate transfer belt 61.

Hereinbelow, first and second ends 611 and 612 provided on intermediate transfer belt 61 are called the first positioning mark, and first and second ends 613 and 614 provided on intermediate transfer belt 61 are called the second positioning mark.

Since the first positioning mark of first guide element 610*a* and the second positioning mark of second guide element 610*b* are arranged symmetrically with respect to the center line that extends along the advancing direction of intermediate transfer belt 61, parallel to, and between, first and second guide elements 610*a* and 610*b*, description hereinbelow will be made taking the example of first guide element 610*a*.

First guide element 610*a* has a guide surface 611*s*2 (FIG. 7) opposing the side end faces of the roller members (62, 63 and 64), an outside surface 611*s*1 (FIG. 7) on the opposite side of guide surface 611*s*2, an opposing surface that opposes collar 62*a* and a bonding surface on the opposite side of the opposing surface and bonded to intermediate transfer belt 61.

As shown in FIGS. 6A and 7, first guide element 610*a* is provided along the inner peripheral surface of intermediate transfer belt 61 so that first and second ends 611 and 612 are arranged so as to oppose each other with a predetermined distance apart therebetween. However, the element is formed continuously and endlessly in appearance.

First end 611 is formed with a first inclined surface 611*b* that is inclined relative to the advancing direction (the direction of arrow X: or also referred to as "the belt advancing direction) of intermediate transfer belt 61.

First inclined surface 611*b* is formed such that first end 611 becomes narrower as the point on the inclined surface goes outward with respect to the width (the direction of arrow Y: also called "the belt width direction") of intermediate transfer belt 61.

Further, first end 611 has first and third perpendicular surface 611*a*1 and 611*a*2 that are formed perpendicularly to the belt advancing direction X and contiguously to the ends of first inclined surface 611*b*.

First perpendicular surface 611*a*1 is formed from one end of first inclined surface 611*b* located on the distal side of first end 611 to outside surface 611*s*1 of first end 611.

Third perpendicular surface 611*a*2 is formed from one end of first inclined surface 611*b* located on the proximal side of first end 611 to guide surface (roller member side) 611*s*2.

First and second ends 611 and 612 are formed point symmetrically, as shown in FIG. 7.

That is, similarly to first end 611, second end 612 has a second inclined surface 612*b* that is inclined relative to the belt advancing direction and second and fourth perpendicular surfaces 612*a*1 and 612*a*2 that are formed perpendicularly to the belt advancing direction and on both sides of second inclined surface 612*b*. Second and fourth perpendicular surfaces 612*a*1 and 612*a*2 are formed contiguously to the ends of second inclined surface 612*b*.

Conversely to first inclined surface 611*b*, second inclined surface 612*b* is formed such that second end 612 becomes narrower as the point on the inclined surface goes toward guide roller surface 611*s*2 (roller member side).

Second perpendicular surface 612*a*1 is formed from one end of second inclined surface 612*b* located on the distal side of second end 612 to guide surface (roller member side) 611*s*2.

Fourth perpendicular surface 612*a*2 is formed from one end of second inclined surface 612*b* located on the proximal side of second end 612 to outside surface 612*s*1.

When the thus configured first and second ends 611 and 612 are positioned in place, first perpendicular surface 611*a*1 and fourth perpendicular surface 612*a*2, third perpendicular surface 611*a*2 and fourth perpendicular surface 612*a*1, and first and second inclined surfaces 611*b* and 612*b*, oppose each other.

As one exemplary configuration of guide element 610, ester-urethane having an Ascar C hardness (The Society of Rubber Industry, Japan Standard (SRIS)) of 66 is used as the base 610BS. The first guide element 610*a* is bonded to intermediate transfer belt 61 by double-sided adhesive tape 610TP using a dedicated device.

In the present embodiment, 300A type double-sided adhesive tape (a product of Kyodo Giken Chemical Co., Ltd.) is used as double-sided adhesive tape 610TP.

Similarly to first guide element 610*a*, in second guide element 610*b*, perpendicular surfaces and inclined surfaces are formed point symmetrically in first and second ends 613 and 614. Similarly to first guide element 610*a*, second guide element 610*b* is formed such that corresponding perpendicular surfaces and corresponding inclined surfaces oppose to each other when first and second ends 613 and 614 are positioned in place.

Figure 9:
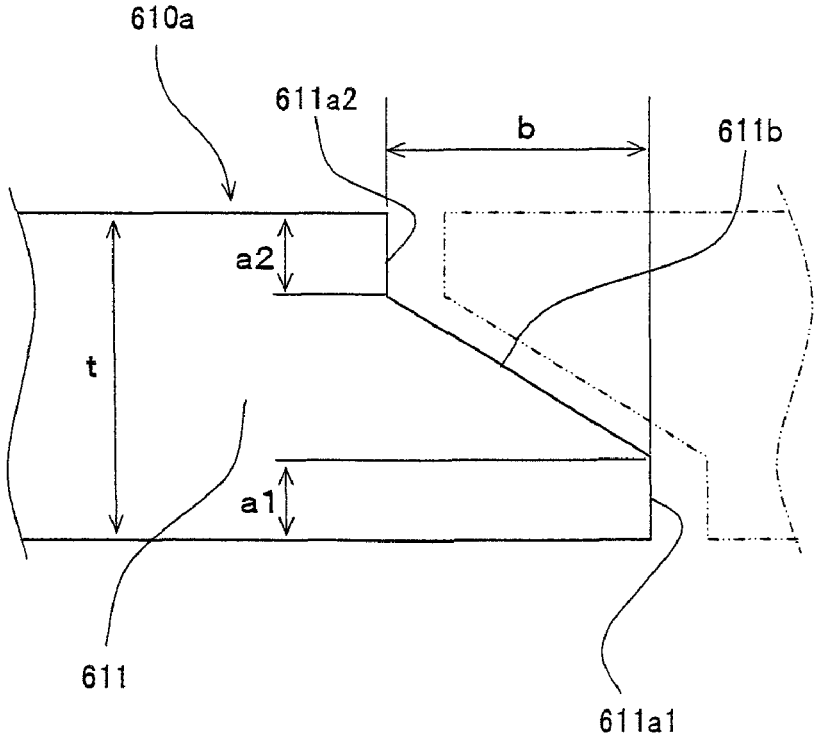
FIG. 9 is an illustrative view showing one exemplary configuration of the ends of the guide element.

Next, the configuration of the guide element will be explained specifically describing first guide element 610*a* as an example. FIG. 9 is an illustrative view showing one exemplary configuration of the ends of the guide element according to the first embodiment.

As shown in FIG. 9, the shape of first end 611 of first guide element 610*a* is preferably specified to satisfy the following relational expressions (1), (2) and (3):

$$1.5\ (\mathrm{mm}) \leqq a1 < 0.5t \quad (1)$$

$$a1 \leqq a2 < 0.5t \quad (2)$$

$$0.8 \leqq b \quad (3)$$

where t is the dimension in the belt width direction Y, of the opposing surface that opposes collar 62*a* of the guide element, a1 is the dimension in the belt width direction Y, of first perpendicular surface 611*a*1, *a*2 is the dimension in the belt width direction Y, of second perpendicular surface 611*a*2 and b is the dimension in the belt advancing direction X, of first inclined surface 611*b*.

With the shape of first guide end 611 of first guide element 610*a* specified as above, it is possible to effectively inhibit guide element 610 from running up on the roller members and peeling off.

Further, as shown in FIG. 7, when the gap in the belt advancing direction, between first and fourth perpendicular surfaces 611*a*1 and 612*a*2 and the gap in the belt advancing direction, between third and second perpendicular surfaces 611*a*2 and 612*a*1 is represented as d1 (d1: the first gap) and the gap in the direction perpendicular to the inclined surfaces, between first and second inclined surfaces 611*b* and 612*b* is represented as d2 (d2: second gap), it is preferable that the circumferential lengths of intermediate transfer belt 61 and guide element 610 are specified so as to satisfy the following conditions:

$$0\ \text{mm} < d1 \leqq 4.0\ \text{mm and } 0\ \text{mm} < d2 \leqq 2.0\ \text{mm}.$$

Detailedly, if the first gap d1 is 0 mm, intermediate transfer belt 61 at the butted portion of the ends bulges over the peripheral side (curved surface) of the roller member, so that the pressure acting on intermediate transfer belt 61 becomes uneven. This causes serious influence on lowering image quality.

If either first gap d1 is greater than 4.0 mm (d1>4.0 mm) or second gap d2 is greater than 2.0 mm (d2>2.0 mm), first and second gaps d1 and d2 are so wide that the risk of the guide element 610 slipping out of place and running up on the roller members becomes high.

According to the first embodiment configured as above, first and second ends 611 and 612 of first guide element 610*a* are formed with first, third, second and fourth perpendicular surfaces 611*a*1, 611*a*2, 612*a*1 and 612*a*2 and first and second inclined surfaces 611*b* and 612*b*, and arranged so as to oppose each other with a predetermined distance apart therebetween. Accordingly, it is possible to bond first and second ends 611 and 612 to intermediate transfer belt 61 with high enough strength. This effect can be obtained because the bonding area of the distal end of the guide element becomes greater than that of the conventional guide element which is formed with an inclined surface alone that is inclined relative to the advancing direction of the intermediate transfer belt.

Further, according to the first embodiment, formation of first and second inclined surfaces 611*b* and 612*b* in first and second ends 611 and 612 of first guide element 610*a* makes it possible to prevent guide element 610 from running up on the roller members. In the conventional intermediate transfer belt in which the gap portion of the guide element is formed with perpendicular surfaces only that are perpendicular to the advancing direction of the intermediate transfer belt, the gap portion that is parallel to the roller member causes the guide element to run up on the roller member. In the present embodiment, the part of the gap portion parallel to the roller member is made smaller by providing first and second inclined surfaces 611*b* and 612*b*, whereby it is possible to make the wall portion continuous so that the guide element will not run up on the roller members.

Here, second guide element 610*b* also has the same configuration as first guide element 610*a*, so that the same operational effect as that of first guide element 610*a* can be achieved.

Though in the first embodiment, guide element 610 is constructed so that first end 611, for example is formed by providing first inclined surface 611*b* between first and third perpendicular surfaces 611*a*1 and 611*a*2, the numbers of inclined surfaces and perpendicular surfaces are not particularly limited as long as the inclined surfaces and perpendicular surfaces are formed at the positioning ends.

Figure 10:
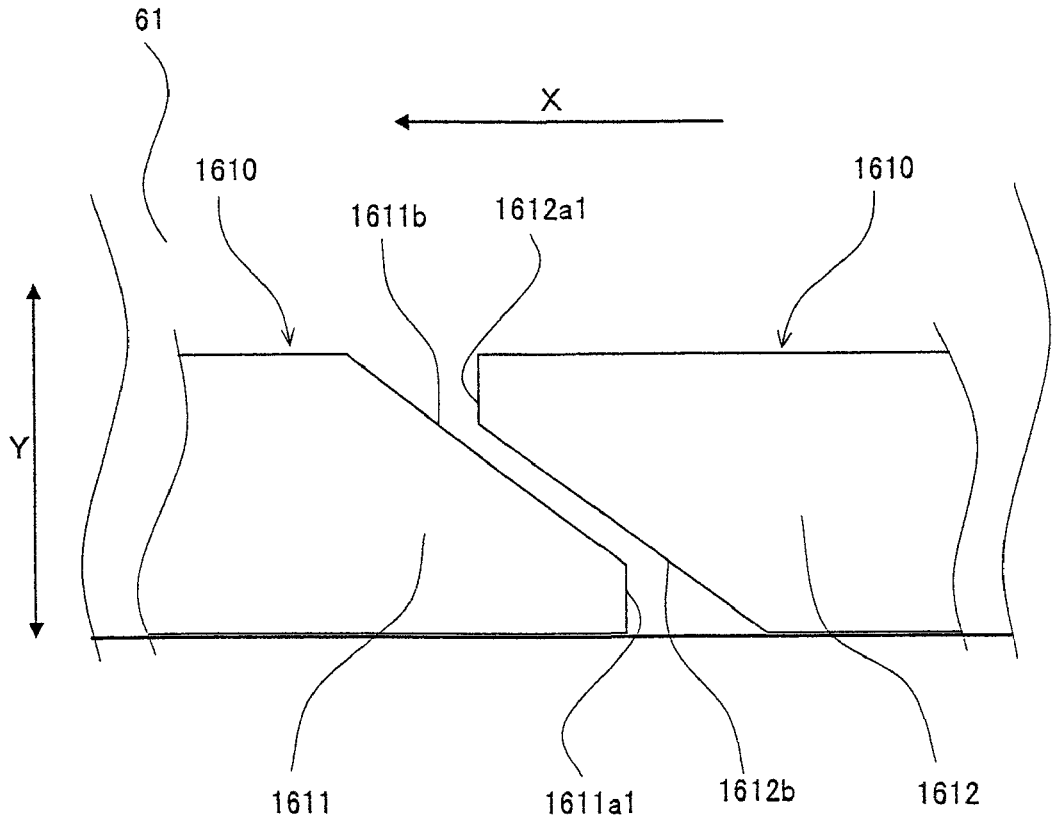
FIG. 10 is an illustrative view showing a variational configuration of a guide element according to the first embodiment.

As a variational example, first and second ends 1611 and 1612 of a guide element 1610 may be formed with first and second inclined surfaces 1611*b* and 1612*b* while first and second perpendicular surfaces 1611*a*1 and 1612*a*1 may be formed in the tapering portions of first and second inclined surfaces 1611*b* and 1612*b*, as shown in FIG. 10. This configuration can produce the same effect as that of guide element 610 of the first embodiment.

The Second Embodiment

Next, the drawings of the second embodiment of the present invention will be described in detail with reference to the drawings.

Figure 11:
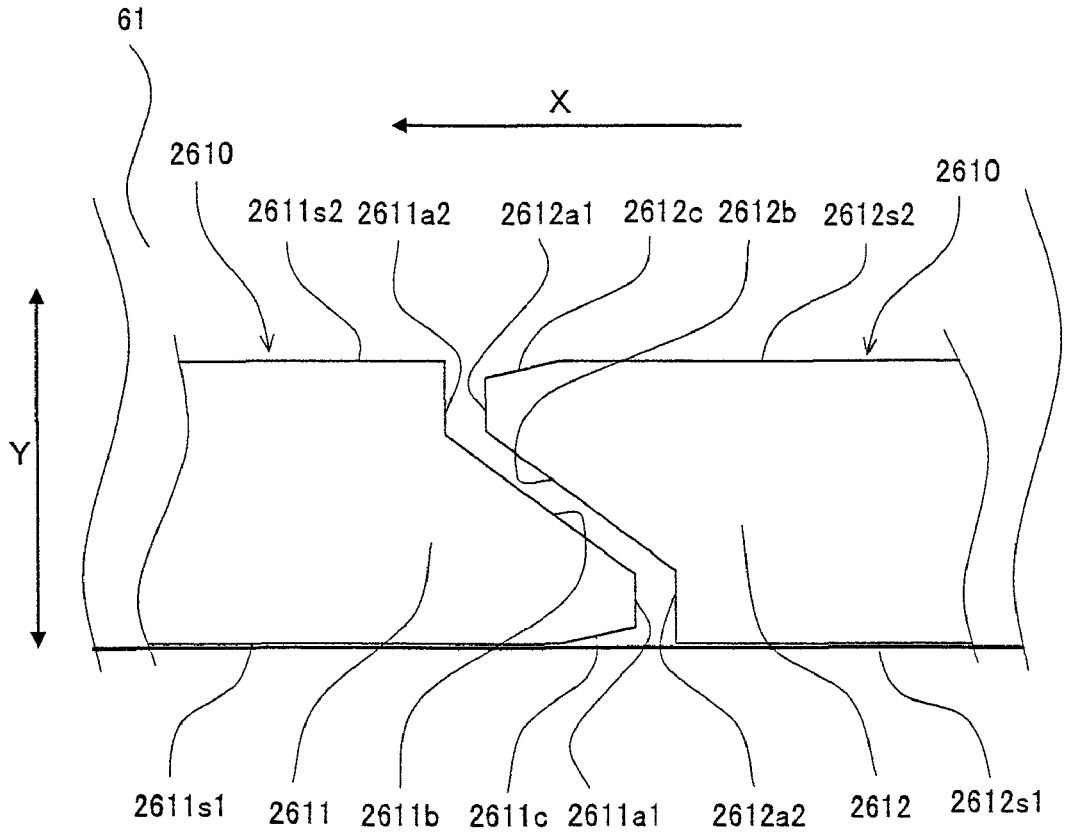
FIG. 11 is an illustrative view showing a configuration of a guide element according to the second embodiment of the present invention.

FIG. 11 is an illustrative view showing a configuration of a guide element according to the second embodiment of the present invention.

Since the transfer device using the guide elements according to the second embodiment and the image forming apparatus using this transfer device have the same configurations as the transfer portion 6 and image forming apparatus 100 of the first embodiment excepting the configuration of the guide elements, description for those is omitted.

Similarly to guide element 610 of the first embodiment, a guide element 2610 according to the second embodiment is provided annularly on endless intermediate transfer belt 61 so that the first and second ends, designated at 2611 and 2612 are opposed to each other with a predetermined distance apart therebetween, as shown in FIG. 11. However, first and second ends 2611 and 2612 are formed so that the guide element is formed continuously and endlessly in appearance along endless intermediate transfer belt 61.

Here, in guide element 2610, components having the same configurations as those of guide element 610 (610*a*) of the first embodiment are allotted with the same reference numerals, so that description is omitted. Further, similarly to the first embodiment, description on the guide element corresponding to guide element 610*b* of the first embodiment is omitted.

First end 2611 is formed with a first inclined surface 2611*b* that is inclined relative to the belt advancing direction (the direction of arrow X). First inclined surface 2611*b* is formed such that first end 2611 becomes narrower as the point on the inclined surface goes toward outside surface 2611*s*1.

Further, first end 2611 has first and third perpendicular surfaces 2611*a*1 and 2611*a*2 that are formed perpendicularly to the belt advancing direction on both sides of first inclined surface 2611*b*. Formed between first perpendicular surface 2611*a*1 and outside surface 2611*s*1 is a fourth inclined surface 2611*c* that is inclined relative to the belt advancing direction (the direction of arrow X).

Second perpendicular surface 2611*a*2 is formed from one end of first inclined surface 2611*b* located on the proximal side of first end 2611 to guide surface 2611*s*2.

First and second ends 2611 and 2612 are formed point symmetrically, as shown in FIG. 11.

Accordingly, similarly to first end 2611, second end 2612 has a second inclined surface 2612*b* that is inclined relative to the belt advancing direction, and second and fourth perpendicular surfaces 2612*a*1 and 2612*a*2 that are formed perpendicularly to the belt advancing direction and on both sides of second inclined surface 2612*b*.

Formed between second perpendicular surface 2612*a*1 and guide surface 2612*s*2 is a third inclined surface 2612*c* that is inclined relative to the belt advancing direction (the direction of arrow X).

Second inclined surface 2612*b* is formed such that the second end 2612 becomes narrower as the point on the inclined surface goes toward guide surface 2612*s*2, conversely to first inclined surface 2611*b*.

The thus configured first and second ends 2611 and 2612 are positioned such that first and fourth perpendicular surfaces 2611*a*1 and 2612*a*2 oppose each other, third and second perpendicular surfaces 2611*a*2 and 2612*a*1 oppose each other, and first and third inclined surfaces 2611*b* and 2612*b* oppose each other.

According to the second embodiment configured as above, provision of fourth and third inclined surfaces 2611*c* and 2612*c* in first and second ends 2611 and 2612 of first guide element 2610 makes it possible to expect a further effect of preventing guide element 2610 from running up on the roller members. This effect can be obtained because provision of fourth and third inclined surfaces 2611*c* and 2612*c* makes it possible to reduce damage to the side edges of first and second ends 2611 and 2612 of guide element 2610 from collision with the ends of the roller members.

Further, according to the second embodiment, formation of the two ends 2611 and 2612 of guide element 2610 in a point symmetrical configuration, makes consideration of the orientation of guide element 2610 unnecessary when the guide element 2610 is attached to intermediate transfer belt 61, hence it is possible to improve work efficiency.

Though in the second embodiment, guide element 2610 is constructed so that first and second ends 2611 and 2612 are formed with fourth and third inclined surfaces 2611*c* and 2612*c*, the present invention is not limited to the above configuration as long as at least the second end 2612, which is located on the guide surface side, is formed with an inclined surface or a curved surface. Next, this will be explained in detail.

Now, variational examples of guide element 2610 according to the second embodiment will be shown.

Figure 12:
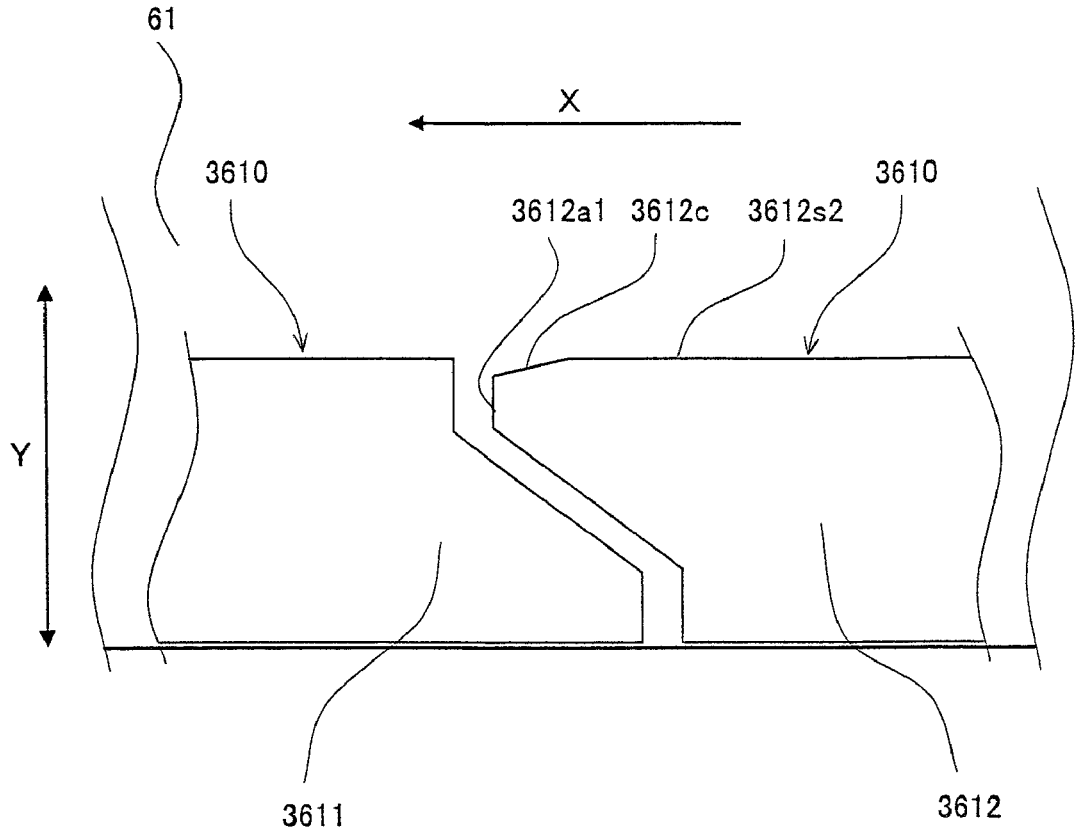
FIG. 12 is an illustrative view showing a variational example 1 of a guide element of the second embodiment.
Figure 13:
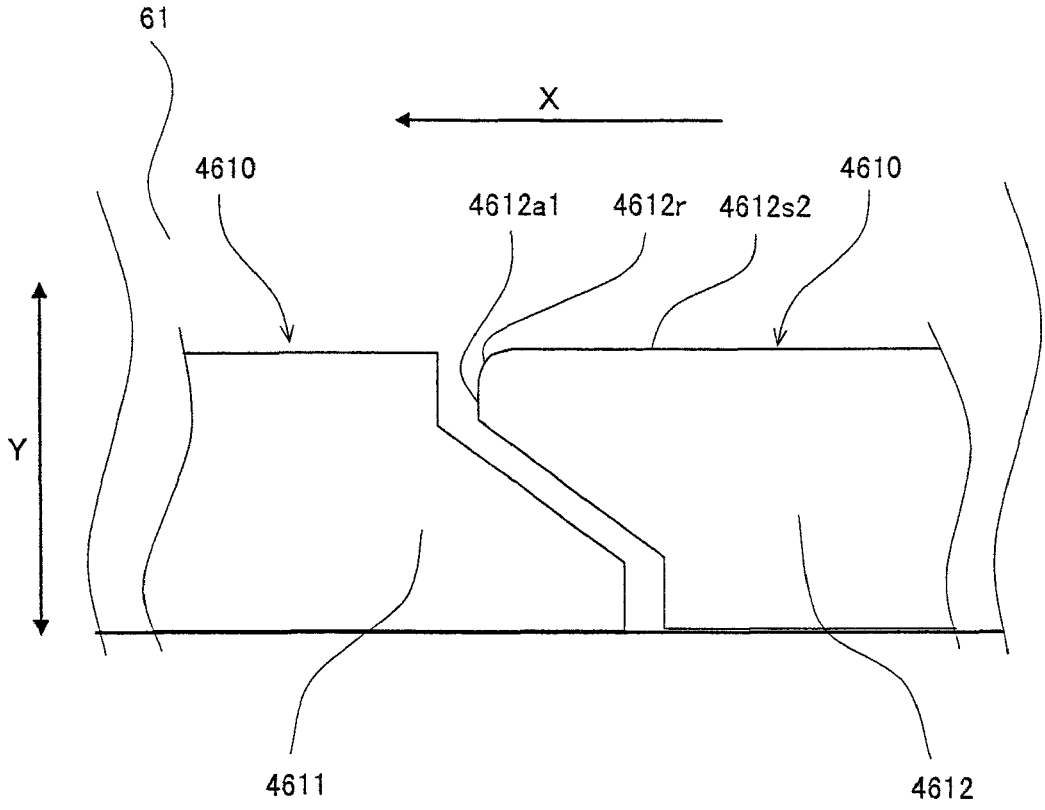
FIG. 13 is an illustrative view showing a variational example 2 of a guide element of the second embodiment.
Figure 14:
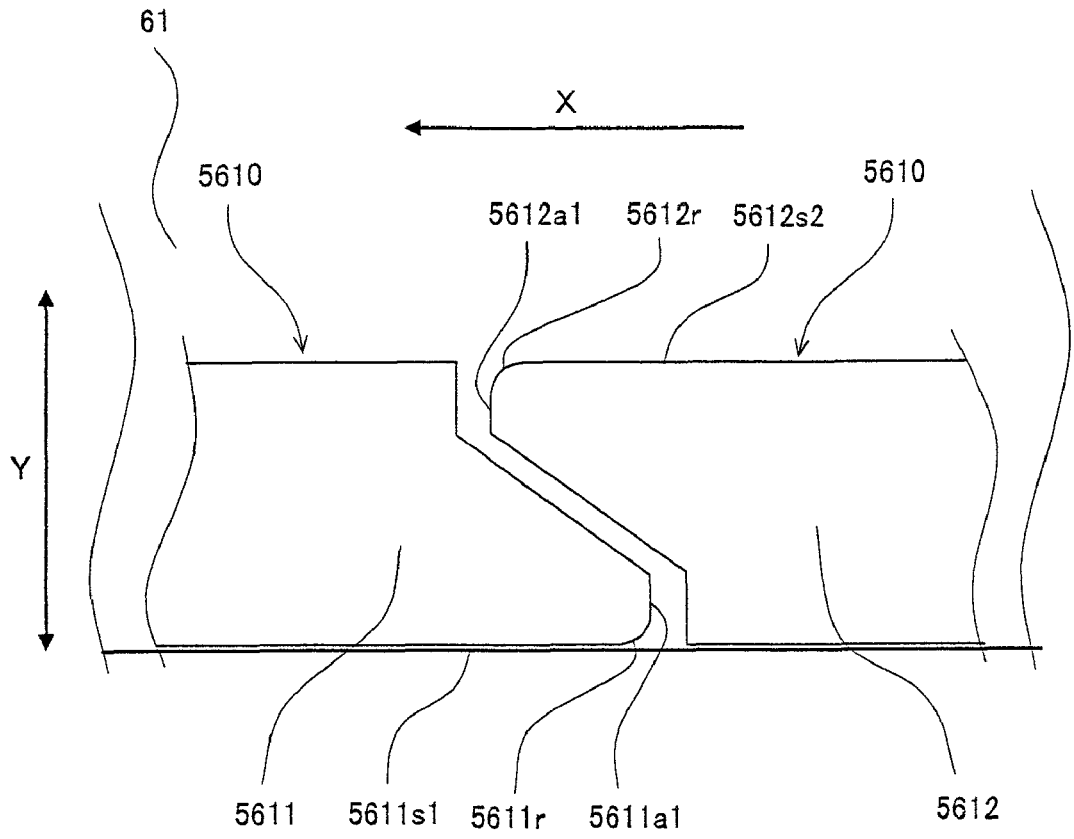
FIG. 14 is an illustrative view showing a variational example 3 of a guide element of the second embodiment.

FIG. 12 is an illustrative view showing a variational example 1 of the guide element of the second embodiment. FIG. 13 is an illustrative view showing a variational example 2 of the guide element. FIG. 14 is an illustrative view showing a variational example 3 of the guide element.

Here, the guide elements of the variational examples will be described only for the components different in configuration and function, and description on the same configurations and functions as those of guide element 2610 of the second embodiment is omitted.

Variational Example 1

Variational example 1 has the same configuration as that of FIG. 11 except in that no fourth inclined surface 2611*c* is formed.

As shown in FIG. 12, in a guide element 3610 of variational example 1, the first and second ends, designated at 3611 and 3612 are arranged so as to oppose each other with a predetermined distance apart therebetween. No inclined surface is formed between the perpendicular surface at the distal side of first end 3611 and the outside surface while a third inclined surface 3612*c* that is inclined relative to the belt advancing direction is formed between the perpendicular surface 3612*a*1 on the guide surface 3612*s*2 side of second end 3612 and guide surface 3612*s*2.

With this configuration, it is possible to omit the step of forming fourth inclined surface 2611*c* of FIG. 11 and inhibit guide element 3610 from running up on the roller members without lowering the strength of other parts.

Variational Example 2

Variational example 2 has the same configuration as that of the above variational example of FIG. 12 except in that the third inclined surface 3612*c* is replaced by a curved surface.

As shown in FIG. 13, in a guide element 4610 of variational example 2, the first and second ends, designated at 4611 and 4612 are arranged so as to oppose each other with a predetermined distance apart therebetween. Neither inclined surface nor curved surface is formed between the perpendicular surface at the distal side of first end 4611 and the outside surface while an R-shaped curved surface 4612*r* is formed between the perpendicular surface 4612*a*1 on the guide surface 4612*s*2 side of second end 4612 and guide surface 4612*s*2.

With this configuration, similarly to the case where inclined surface 2612*c* or 3612*c* shown in FIGS. 11 and 12 is formed, it is possible by curved surface 4612*r* to inhibit guide element 4610 from running up on the roller members without lowering the strength of other parts.

Variational Example 3

Variational example 3 has the same configuration as that of the above variational example of FIG. 13 except in that an R-shaped curved surface is also formed between the perpendicular surface at the distal side of the first end 4611 and the outside surface.

As shown in FIG. 14, in a guide element 5610 of variational example 3, the first and second ends, designated at 5611 and 5612 are arranged so as to oppose each other with a predetermined distance apart therebetween. An R-shaped second curved surface 5611*r* is formed between the perpendicular surface 5611*a*1 on the distal side of first end 5611 and the outside surface and an R-shaped first curved surface 5612*r* is formed between the perpendicular surface 5612*a*1 on the distal side of second end 5612 and guide surface 5612*s*2. These first and second ends 5611 and 5612 are formed point symmetrically.

With this configuration, it is possible to achieve the same effect as the case where fourth and third inclined surfaces 2611*c* and 2612*c* of FIG. 11 are provided. Further, formation of the two ends 5611 and 5612 of guide element 5610 in a point symmetrical configuration, makes consideration of the orientation of guide element 5610 unnecessary when the guide element 5610 is attached to intermediate transfer belt 61, hence it is possible to improve work efficiency.

Having described the preferred embodiment of the present invention, the present invention should not be limited to the above-described embodiments and examples, and various changes can be made within the scope of the appended claims. That is, any embodied mode obtained by combination of technical means disclosed in the above embodiments should be included in the technical art of the present invention.

For example, it is not necessary to limit the first positioning mark and the second positioning mark to being arranged symmetrically with respect to the center line that extends between the first and second guide elements along the advancing direction of intermediate transfer belt 61. That is, the same operational effect can be obtained if the configurations shown in the above embodiments are selectively used in an asymmetrical arrangement.

Further, the first positioning mark and the second positioning mark may be arranged either in phase or out of phase with respect to the advancing direction of intermediate transfer belt 61.

Further, the present invention is applied to a color image forming apparatus (multifunctional machine, printer etc.), but the invention can be applied to other image forming apparatuses such as a monochrome image forming apparatus etc., as long as it uses an endless intermediate transfer belt to perform image forming.

What is claimed is:

1. A transfer device for use in an image forming apparatus that forms images with toner based on electrophotography, comprising:

an endless belt having a toner image temporarily transferred from a photoreceptor drum;

roller members that support and stretch the endless belt; and, strip-like guide elements that guide conveyance of the endless belt along both ends of the roller members with respect to the width direction, characterized in that the guide element includes first and second ends;

the guide element is formed on the inner peripheral surface of the endless belt that opposes the roller members;

the first and second ends are arranged so as to oppose each other with a predetermined gap apart therebetween, on the inner peripheral surface;

the first end is formed with a first perpendicular surface that is perpendicular to the advancing direction of the endless belt and a first inclined surface that is inclined relative to the advancing direction; and the second end is formed with a second perpendicular surface that is perpendicular to the advancing direction and a second inclined surface that is inclined relative to the advancing direction.

2. The transfer device according to claim 1, wherein the first and second perpendicular surfaces are formed so as to extend from at least one side of both sides of the first and second inclined surfaces, respectively.

3. The transfer device according to claim 2, wherein the first and second perpendicular surfaces are formed in positions where the first and second ends become tapered by the first and second inclined surfaces, respectively.

4. The transfer device according to claim 3, wherein the second perpendicular surface is formed between the second inclined surface and a guide surface that opposes the ends of the roller members.

5. The transfer device according to claim 4, wherein the second end includes a third inclined surface that is inclined relative to the advancing direction or a curved surface between the second perpendicular surface and the guide surface.

6. The transfer device according to claim 1, wherein, when the first and second ends are arranged so as to oppose each other with the predetermined gap apart therebetween, the first end and the opposing second end are formed in a point-symmetrical configuration.

7. An image forming apparatus for forming images using toner based on electrophotography, comprising:

a photoreceptor drum for forming an electrostatic latent image on the surface thereof;

a charging device for electrifying the surface of the photoreceptor drum;

an exposure device for forming the electrostatic latent image on the surface of the photoreceptor drum;

a developing device for forming a toner image by supplying toner to the electrostatic latent image on the surface of the photoreceptor drum;

a transfer device for transferring the toner image on the surface of the photoreceptor drum to a recording medium; and, a fixing device for fixing the transferred toner image to the recording medium, characterized in that the transfer device uses the transfer device defined in claim 1.

* * * * *